US005865988A

United States Patent [19]

Collins et al.

[11] Patent Number: 5,865,988

[45] Date of Patent: Feb. 2, 1999

[54] HYDROCARBON UPGRADING PROCESS

[75] Inventors: Nick A. Collins, Medford, N.J.; Paul P. Durand, Wilmington, Del.; Timothy L. Hilbert, Sewell, N.J.; Gerald J. Teitman, Vienna, Va.; Jeffrey C. Trewella, Kennett Square, Pa.

[73] Assignee: Mobil Oil Corporation, Fairfax, Va.

[21] Appl. No.: 862,238

[22] Filed: May 23, 1997

Related U.S. Application Data

[63] Continuation of Ser. No. 499,240, Jul. 7, 1995, abandoned.

[51] Int. Cl.[6] ..... G10G 69/08

[52] U.S. Cl. ..... 208/97; 208/95; 208/62; 208/134; 208/135

[58] Field of Search ..... 208/97, 95, 62, 208/134, 135, 211; 585/322, 412, 413

[56] References Cited

U.S. PATENT DOCUMENTS

| | | | |
|---|---|---|---|
| 3,442,792 | 5/1969 | Eng et al. | 208/97 |
| 3,533,937 | 10/1970 | Stankis | 208/62 |
| 3,801,494 | 4/1974 | Moore et al. | 208/62 |
| 3,957,625 | 5/1976 | Orkin | 208/211 |
| 3,959,116 | 5/1976 | Arey, Jr. et al. | 208/62 |
| 4,950,387 | 8/1990 | Harandi et al. | 585/322 |
| 4,975,179 | 12/1990 | Harandi et al. | 208/62 |
| 5,143,596 | 9/1992 | Maxwell et al. | 28/89 |
| 5,292,976 | 3/1994 | Dessau et al. | 208/62 |
| 5,346,609 | 9/1994 | Fletcher et al. | 208/89 |
| 5,347,061 | 9/1994 | Harandi et al. | 208/62 |
| 5,396,010 | 3/1995 | Harandi et al. | 585/322 |
| 5,409,596 | 4/1995 | Fletcher et al. | 208/89 |
| 5,414,172 | 5/1995 | Chin et al. | 585/322 |

FOREIGN PATENT DOCUMENTS

| | | |
|---|---|---|
| 420326B1 | 2/1995 | European Pat. Off. . |

*Primary Examiner*—Walter D. Griffin

*Attorney, Agent, or Firm*—Penny L. Prater; Malcolm D. Keen

[57] ABSTRACT

Low sulfur gasoline is produced from an olefinic, cracked, sulfur-containing naphtha by treatment over an acidic catalyst, preferably an intermediate pore size zeolite such as ZSM-5 to crack low octane paraffins and olefins under relatively mild conditions, with limited aromatization of olefins and naphthenes. This is followed by hydrodesulfurization over a hydrotreating catalyst such as CoMo on alumina. The initial treatment over the acidic catalyst removes the olefins which would otherwise be saturated in the hydrodesulfurization, consuming hydrogen and lowering product octane, and converts them to compounds which make a positive contribution to octane. Overall liquid yield is high, typically at least 90 percent of higher. Product aromatics are typically increased by no more than 25 weight percent relative to the feed and may be lower than the feed.

16 Claims, No Drawings

HYDROCARBON UPGRADING PROCESS

CROSS REFERENCE TO RELATED APPLICATIONS

This application is a continuation of application Ser. No. 08/499,240, filed Jul. 7, 1995, now abandoned, which is related to Ser. No. 07/850,106, filed 12 Mar. 1992, now U.S. Pat. No. 5,409,596, which is a continuation-in-part of prior application Ser. No. 07/745,311, filed 15 Aug. 1991, now U.S. Pat. No. 5,346,609, which describe processes for producing low sulfur gasolines. Reference is made to these two applications for details of these processes. This application is also related to application Ser. No. 08/499,239, now abandoned, filed concurrently (Mobil Case 7699) which describes a similar process in which a benzene-rich stream such as reformate is added during the processing to produce incremental product octane and reduce the level of benzene in the added feedstream.

FIELD OF THE INVENTION

This invention relates to a process for the upgrading of hydrocarbon streams. It more particularly relates to a process for upgrading gasoline boiling range petroleum fractions containing substantial proportions of sulfur impurities while minimizing the octane loss which occurs upon hydrogenative removal of the sulfur.

BACKGROUND OF THE INVENTION

Catalytically cracked gasoline forms a major part of the gasoline product pool in the United States. When the cracking feed contains sulfur, the products of the cracking process usually contain sulfur impurities which normally require removal, usually by hydrotreating, in order to comply with the relevant product specifications. These specifications are expected to become more stringent in the future, possibly permitting no more than about 300 ppmw sulfur (or even less) in motor gasolines and other fuels. Although product sulfur can be reduced by hydrodesulfurization of cracking feeds, this is expensive both in terms of capital construction and in operating costs since large amounts of hydrogen are consumed.

As an alternative to desulfurization of the cracking feed, the products which are required to meet low sulfur specifications can be hydrotreated, usually using a catalyst comprising a Group VIII or a Group VI element, such as cobalt or molybdenum, either on their own or in combination with one another, on a suitable substrate, such as alumina. In the hydrotreating process, the molecules containing the sulfur atoms are mildly hydrocracked to convert the sulfur to inorganic form, hydrogen sulfide, which can be removed from the liquid hydrocarbon product in a separator. Although this is an effective process that has been practiced on gasolines and heavier petroleum fractions for many years to produce satisfactory products, it does have disadvantages.

Cracked naphtha, as it comes from the catalytic cracker and without any further treatments, such as purifying operations, has a relatively high octane number as a result of the presence of olefinic components and as such, cracked gasoline is an excellent contributor to the gasoline octane pool. It contributes a large quantity of product at a high blending octane number. In some cases, this fraction may contribute as much as up to half the gasoline in the refinery pool.

Other highly unsaturated fractions boiling in the gasoline boiling range, which are produced in some refineries or petrochemical plants, include pyrolysis gasoline produced as a by-product in the cracking of petroleum fractions to produce light olefins, mainly ethylene and propylene. Pyrolysis gasoline has a very high octane number but is quite unstable in the absence of hydrotreating because, in addition to the desirable olefins boiling in the gasoline boiling range, it also contains a substantial proportion of diolefins, which tend to form gums after storage or standing.

Hydrotreating these sulfur-containing cracked naphtha fractions normally causes a reduction in the olefin content, and consequently a reduction in the octane number; as the degree of desulfurization increases, the octane number of the gasoline boiling range product decreases. Some of the hydrogen may also cause some hydrocracking as well as olefin saturation, depending on the conditions of the hydrotreating operation.

Various proposals have been made for removing sulfur while retaining the olefins which make a positive contribution to octane. Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina. U.S. Pat. No. 4,049,542 (Gibson) discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and the need to produce cleaner burning, less polluting, low sulfur fuels. This inherent tension is yet more marked in the current supply situation for low sulfur, sweet crudes.

Other processes for treating catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

U.S. Pat. No. 5,143,596 (Maxwell) and EP 420 326 B1 describe processes for upgrading sulfur-containing feedstocks in the gasoline range by reforming with a sulfur-tolerant catalyst which is selective towards aromatization. Catalysts of this kind include metal-containing crystalline silicates including zeolites such as gallium-containing ZSM-5. The process described in U.S. Pat. No. 5,143,596 hydrotreats the aromatic effluent from the reforming step. Conversion of naphthenes and olefins to aromatics is at least 50 percent under the severe conditions used, typically temperatures of at least 400° C. (750° F.) and usually higher, e.g.

500° C. (about 930° F.). Under similar conditions, conventional reforming is typically accompanied by significant and undesirable yield losses, typically as great as 25 percent and the same is true of the processes described in these publications: $C_5$+ yields in the range of about 50 to 85 percent are reported in EP 420 326. This process therefore suffers the traditional drawback of reforming so that the problem of devising a process which is capable of reducing the sulfur level of cracked naphthas while minimizing yield losses as well as reducing hydrogen consumption has remained.

U.S. Pat. No. 5,346,609 describes a process for reducing the sulfur of cracked naphthas by first hydrotreating the naphtha to convert sulfur to inorganic form followed by treatment over a catalyst such as ZSM-5 to restore the octane lost during the hydrotreating step, mainly by shape-selective cracking of low octane paraffins. This process, which has been successfully operated commercially, produces a low-sulfur naphtha product in good yield which can be directly incorporated into the gasoline pool.

SUMMARY OF THE INVENTION

We have now devised a process for catalytically desulfurizing cracked fractions in the gasoline boiling range which enables the sulfur to be reduced to acceptable levels without substantially reducing the octane number. The benefits of the present process include reduced hydrogen consumption and reduced mercaptan formation, in comparison with the process described in U.S. Pat. No. 5,346,609 and higher yields than are achieved with reforming, including processes such as those described in U.S. Pat. No. 5,143,596 and EP 420 326 B1.

According to the present invention, the process for upgrading cracked naphthas comprises a first catalytic processing step in which shape selective cracking of low octane paraffins and olefins takes place under mild conditions so that aromatization of olefins and naphthenes in the feed is held at a low level, typically no more than 25 weight percent. A hydrotreating step which follows reduces sulfur content and is less detrimental to octane as a result of the removal of olefins during the first step, results in product octane ratings close to or even exceeding that of the original naphtha feed. Total liquid ($C_5$+) yields are high, typically at least 90 weight percent as a consequence of the mild conditions employed in the first step of the process with its limited degree of aromatization. By converting the cracked naphtha olefins prior to the hydrotreating step, olefin saturation and hydrogen consumption are reduced. Also, by placing the hydrodesulfurization last, mercaptan formation by $H_2S$-olefin combination over the zeolite catalyst is eliminated, potentially leading to higher desulfurization or mitigating the need to treat the product further, for example, as described in U.S. application Ser. No. 08/001,681, now U.S. Pat. No. 5,318,690.

The process may be utilized to desulfurize light and full range naphtha fractions while maintaining octane so as to obviate the need for reforming such fractions, or at least, without the necessity of reforming such fractions to the degree previously considered necessary.

In practice it may be desirable to hydrotreat the cracked naphtha before contacting it with the catalyst in the first aromatization/cracking step in order to reduce the diene content of the naphtha and so extend the cycle length of the catalyst. Only a very limited degree of olefin saturation occurs in the pretreater and only a minor amount of desulfurization takes place at this time.

Detailed Description

Feed

The feed to the process comprises a sulfur-containing petroleum fraction which boils in the gasoline boiling range. Feeds of this type typically include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. In many cases, the feed will be have a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

Catalytic cracking is a suitable source of cracked naphthas, usually fluid catalytic cracking (FCC) but thermal cracking processes such as coking may also be used to produce usable feeds such as coker naphtha, pyrolysis gasoline and other thermally cracked naphthas.

The process may be operated with the entire gasoline fraction obtained from a catalytic or thermal cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of the cracked fraction will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent. Dienes are frequently present in thermally cracked naphthas but, as described below, these are preferably removed hydrogenatively as a pretreatment step.

Process Configureation

The selected sulfur-containing, gasoline boiling range feed is treated in two steps by first passing the naphtha over a shape selective, acidic catalyst to selectively crack low octane paraffins and to convert some of the olefins and naphthenes to aromatics and aromatic side chains by alkylation of aromatics originally present in the feed or formed by olefin conversion. The effluent from this step is then passed to a hydrotreating step in which the sulfur compounds present in the naphtha feed, which are mostly unconverted in the first step, are converted to inorganic form ($H_2S$), permitting removal in a separator following the hydrodesulfurization. Because the first (cracking/aromatization) step does not produce any products which interfere with the operation of the second step, the first stage effluent may be cascaded directly into the second stage without the need for interstage separation.

During the first step of the process, the naphtha feed is first treated by contact with an acidic catalyst under conditions which result in some aromatization of the olefins which are present in the feed as a result of the cracking together with shape-selective cracking of low octane paraffins and olefins. Because the olefins readily form aromatics in the presence of the selected catalysts, conditions are relatively mild in this step and yield losses are held at a low level. The degree of aromatization is limited, with the aromatic content of the first stage effluent being comparable to that of the feed. Over both steps of the process, the aromatization is below 50 weight percent (conversion of olefins and naphthenes to aromatics). Conversion of olefins and naphthenes to aromatics is typically below 25 weight percent and is often lower, e.g. no more than 10 or 15 weight percent. At low first stage temperatures, when the overall process chemistry will be dominated by the hydrotreatment taking place in the second stage, the final product may contain less aromatics than the feed due to aromatic saturation over the hydrotreating catalyst. The mild conditions allied with the low aromatization results in a high liquid ($C_5$+) yield, typically at least 90 percent (vol.) or higher, e.g. 95 percent (vol.) of higher. In some cases, the $C_5$+ yield may be over 100 percent (vol.) as a result of the low aromatization coupled with the volume expansion during the hydrotreating.

The particle size and the nature of the catalysts used in both stages will usually be determined by the type of process used, such as: a down-flow, liquid phase, fixed bed process; an up-flow, fixed bed, trickle phase process; an ebulating, fluidized bed process; or a transport, fluidized bed process. All of these different process schemes, which are well known, are possible although the down-flow fixed bed arrangement is preferred for simplicity of operation.

First Stage Processing

Compositionally, the first stage of the processing is marked by a shape-selective cracking of low octane components in the feed coupled with a limited degree of aromatization of naphthenes and olefins to form aromatics and aromatic side chains by alkylation of aromatics. The olefins are derived from the feed as well as an incremental quantity from the cracking of feed paraffins. Some isomerization of n-paraffins to branched-chain paraffins of higher octane may take place, making a further contribution to the octane of the final product. The conditions used in this step of the process are those which result in the controlled degree of shape-selective cracking of low octane paraffins, mainly n-paraffins, in the naphtha feed, together with conversion of olefins in the feed and from the paraffin cracking to form aromatics and alkylation of aromatics with the olefins. Typically, the temperature of the first step will be from about 300° to 850° F. (about 150° to 455° C.), preferably about 350° to 800° F. (about 177° C. to about 427° C.). The pressure in this reaction zone is not critical since hydrogenation is not taking place although a lower pressure in this stage will tend to favor olefin production by paraffin cracking. The pressure will therefore depend mostly on operating convenience. Pressure will typically be about 50 to 1500 psig (about 445 to 10445 kPa), preferably about 300 to 1000 psig (about 2170 to 7000 kPa) with space velocities typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$) will be selected to minimize catalyst aging.

A change in the volume of gasoline boiling range material typically takes place in the first step. Some decrease in product liquid volume occurs as the result of the conversion to lower boiling products ($C_5$–) but the conversion to $C_5$– products is typically not more than 10 vol percent and usually below 5 vol percent. A minor decrease in liquid volume normally takes place as a consequence of the conversion of olefins to the aromatic compounds or their incorporation into aromatics, but as a result of the limited degree of aromatization under the mild reaction conditions, this is typically no more than about 5 percent. If the feed includes significant amounts of higher boiling components, the amount of $C_5$– products may be relatively lower and for this reason, the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the first step of the process possesses sufficient acidic functionality to bring about the desired cracking, aromatization and alkylation reactions. For this purpose, it will have a significant degree of acid activity, and for this purpose the most preferred materials are the solid, crystalline molecular sieve catalytic materials solids having an intermediate pore size and the topology of a zeolitic behaving material, which, in the aluminosilicate form, has a constraint index of about 2 to 12. The preferred catalysts for this purpose are the intermediate pore size zeolitic behaving catalytic materials, exemplified by the acid acting materials having the topology of intermediate pore size aluminosilicate zeolites. These zeolitic catalytic materials are exemplified by those which, in their aluminosilicate form have a Constraint Index between about 2 and 12. Reference is made to U.S. Pat. No. 4,784,745 for a definition of Constraint Index and a description of how this value is measured as well as details of a number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22, MCVM-36, MCM-49 and MCM-56, preferably in the aluminosilicate form. (The newer catalytic materials identified by the MCM numbers are disclosed in the following patents: zeolite MCM-22 is described in U.S. Pat. No. 4,954,325, MCM-36 in U.S. Pat. Nos. 5,250,277 and 5,292,698, MCM-49 in U.S. Pat. No. 5,236,575 and MCM-56 in U.S. Pat. No. 5,362,697). Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4. Other refractory solid materials which have the desired acid activity, pore structure and topology may also be used.

The catalyst should have sufficient acid activity to convert the appropriate components of the feed naphtha as described above. One measure of the acid activity of a catalyst is its alpha number. The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980). The catalyst used in this step of the process suitably has an alpha activity of at least about 20, usually in the range of 20 to 800 and preferably at least about 50 to 200. It is inappropriate for this catalyst to have too high an acid activity because it is desirable to only crack and rearrange so much of the feed naphtha as is necessary to maintain octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The catalyst used in this step of the process may be free of any metal hydrogenation component or it may contain a metal hydrogenation function. If found to be desirable under the actual conditions used with particular feeds, metals such as the Group VIII base metals, especially molybdenum, or combinations will normally be found suitable. Noble metals such as platinum or palladium will normally offer no advantage over nickel or other base metals.

Second Step Hydrotreating

The hydrotreating of the first stage effluent may be effected by contact of the feed with a hydrotreating catalyst. Under hydrotreating conditions, at least some of the sulfur present in the naphtha which passes unchanged thorough the cracking/aromatization step is converted to hydrogen sulfide which is removed when the hydrodesulfurized effluent is passed to the separator following the hydrotreater. The hydrodesulfurized product boils in substantially the same boiling range as the feed (gasoline boiling range), but which has a lower sulfur content than the feed. Product sulfur levels are typically below 300 ppmw and in most cases below 50 ppmw. Nitrogen is also reduced to levels typically below about 50 ppmw, usually below 10 ppmw, by conversion to ammonia which is also removed in the separation step.

If a pretreatment step is used before the first stage catalytic processing, the same type of hydrotreating catalyst may be used as in the second step of the process but conditions may be milder so as to minimize olefin saturation and hydrogen consumption. Since saturation of the first double bond of dienes is kinetically/thermodynamically favored over saturation of the second double bond, this objective is capable of achievement by suitable choice of conditions. Suitable combinations of processing parameters such as temperature, hydrogen pressure and especially space velocity, may be found by empirical means. The pretreater effluent may be cascaded directly to the first processing stage, with any slight exotherm resulting from the hydrogenation reactions providing a useful temperature boost for initiating the mainly endothermic reactions of the first stage processing.

Consistent with the objective of maintaining product octane and volume, the conversion to products boiling below the gasoline boiling range (C5−) during the second, hydrodesulfurization step is held to a minimum. The temperature of this step is suitably from about 400° to 850° F. (about 220° to 454° C.), preferably about 500° to 750° F. (about 260° to 400° C.) with the exact selection dependent on the desulfurization required for a given feed with the chosen catalyst. A temperature rise occurs under the exothermic reaction conditions, with values of about 20° to 100° F. (about 11° to 55° C.) being typical under most conditions and with reactor inlet temperatures in the preferred 500° to 750° F. (260° to 400° C.) range.

Since the desulfurization of the cracked naphthas normally takes place readily, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.) The extent of the desulfurization will depend on the feed sulfur content and, of course, on the product sulfur specification with the reaction parameters selected accordingly. Normally the process will be operated under a combination of conditions such that the desulfurization should be at least about 50%, preferably at least about 75%, as compared to the sulfur content of the feed.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the down-flow, fixed-bed type of operation preferred.

EXAMPLES

A 210° F.+ (99° C.+) fraction of an FCC naphtha with the composition and properties given in Table 1 below was co-fed with hydrogen to a fixed-bed reactor containing a ZSM-5 catalyst having the properties set out in Table 2 below.

TABLE 1

| FCC Naphtha Properties | |
|---|---|
| Sulfur, wt % | 0.20 |
| Nitrogen, ppmw | 98 |
| Clear Research Octane, R + O | 93 |
| Motor octane | 81.5 |
| Bromine number | 37.1 |
| Density, 60° C., g.cc$^{-1}$ | 0.8191 |
| Composition, wt % | |
| $C_6$–$C_{10}$ Paraffins | 1.9 |
| $C_6$–$C_{10}$ Iso-paraffins | 8.7 |
| $C_6$–$C_{10}$ Olefins and cycloolefins | 16.3 |
| $C_6$–$C_{10}$ Naphthenes | 7.2 |
| $C_6$–$C_{10}$ Aromatics | 44.5 |
| $C_{11}^+$ | 21.4 |

TABLE 2

| ZSM-5 Catalyst Properties | |
|---|---|
| Zeolite | ZSM-5 |
| Binder | Alumina |
| Zeolite loading, wt. pct. | 65 |
| Binder, wt. pct. | 35 |
| Catalyst alpha | 110 |
| Surface area, m$^2$ g$^{-1}$ | 315 |
| Pore vol., cc.g$^{-1}$ | 0.65 |
| Density, real, g.cc.$^{-1}$ | 2.51 |
| Density, particle, g.cc.$^{-1}$ | 0.954 |

The total effluent from the first reactor was cascaded to a second fixed bed reactor containing a commercial CoMo/$Al_2O_3$ catalyst (Akzo K742-3Q™). The feed rate was constant such that the liquid hourly space velocity over the ZSM-5 catalyst was 1.0 hr.$^{-1}$ and 2.0 hr.$^{-1}$ over the hydrotreating catalyst. Total reactor pressure was maintained at about 590 psig and hydrogen co-feed was constant at about 2000 SCF/Bbl (356 n. l. l.$^{-1}$) of naphtha feed. The temperature of the ZSM-5 reactor was varied from 400°–800° F. (about 205°–427° C.) while the HDT reactor temperature was 500°–700° F. (about 260°–370° C.). The results are shown in Table 3 below.

TABLE 3

| FCC Naphtha Upgrading Results | | | | |
|---|---|---|---|---|
| ZSM-5 Temperature, °F. | 400 | 750 | 800 | 800 |
| HDT Temperature, °F. | 700 | 700 | 700 | 500 |
| $H_2$ Consumption, scfb | 480 | 3.80 | 330 | 220 |
| $C_5$+ Yield, vol % of feed | 102.3 | 96.6 | 92.1 | 92.2 |
| Yield, wt % of HC feed | | | | |
| $C_1$–$C_2$ | 0.1 | 0.3 | 0.8 | 0.7 |
| Propane | 0.4 | 1.5 | 2.9 | 2.5 |
| N-Butane | 0.2 | 1.8 | 2.6 | 2.4 |

TABLE 3-continued

| FCC Naphtha Upgrading Results | | | | |
|---|---|---|---|---|
| Isobutane | 0.2 | 1.6 | 2.4 | 2.1 |
| N-Pentane | 0.1 | 1.0 | 1.2 | 1.1 |
| Isopentane | 0.2 | 2.5 | 2.4 | 2.1 |
| Pentenes | 0.0 | 0.0 | 0.0 | 0.2 |
| Total $C_6$+ | 99.5 | 91.7 | 88.0 | 89.0 |
| $C_6$–$C_{10}$ N-Paraffins | 5.5 | 2.2 | 1.8 | 1.9 |
| $C_6$–$C_{10}$ Isoparaffins | 18.0 | 13.6 | 11.4 | 11.1 |
| $C_6$–$C_{10}$ Olefins | 0.0 | 0.0 | 0.0 | 1.1 |
| $C_6$–$C_{10}$ Naphthenes | 16.9 | 15.9 | 13.8 | 11.2 |
| $C_6$–$C_{10}$ Aromatics | 40.9 | 42.8 | 46.0 | 47.8 |
| $C_{11}$+ | 19.2 | 18.5 | 16.2 | 16.6 |
| Total Sulfur, ppmw | 35 | 29 | 22 | 37 |
| Nitrogen, ppmw | 1 | <1 | 2 | 45 |
| Aromatization of $C_6$–$C_{10}$ olefins/naphthenes* | (15) | (7) | 6 | 14 |
| $C_5$+ Research Octane | 79.9 | 88.4 | 90.3 | 92.2 |
| $C_5$+ Motor Octane | 72.7 | 80.5 | 82.1 | 82.7 |

Note:
Values shown () represent negative values (decreases) and reflect less aromatics in the product than in the feed.

As shown in Table 3, increasing the temperature of the ZSM-5 at constant HDT severity leads to increasing octanes and reduced $C_5$+ yields. Desulfurization levels above 98 percent may be achieved. Hydrogen consumption decreases with increasing ZSM-5 temperature due to the increased conversion of the cracked naphtha olefins over the acidic catalyst rather than from hydrogen consuming reactions over the HDT catalyst; hydrogen consumption may be reduced further by reducing HDT temperature to 500° F. (about 260° C.) with little effect on hydrodesulfurization. This lower HDT temperature also leads to increased product octane as aromatic saturation is reduced. Aromatization of feed olefins and naphthenes is held at a low level and over both process steps, the level of aromatics may even be decreased relative to the feed. Liquid yields are high in all cases, with the highest yields being obtained at low first step temperatures when increases in product volume may be achieved.

We claim:

1. A process of upgrading a sulfur-containing, olefinic feed fraction boiling in the gasoline boiling range which comprises paraffins including n-paraffins, olefins and aromatics, the process comprising:

contacting the sulfur-containing feed fraction in a first step under mild cracking conditions comprising temperature between 400° F. and 800° F. with a solid acidic catalyst consisting essentially of ZSM-5 zeolite having an acid activity comprising an alpha value between 20 and 800 to convert olefins present in the feed to aromatics and aromatic side-chains and to crack low octane paraffins and olefins in the feed and form an intermediate product, contacting the intermediate product with a hydrodesulfurization catalyst under a combination of elevated temperature, elevated pressure and an atmosphere comprising hydrogen, to convert sulfur-containing compounds in the intermediate product to inorganic sulfur compounds and produce at least a 90 weight percent yield, based on said feed fraction, of a desulfurized product comprising a normally liquid fraction in the gasoline boiling range containing less than 50 weight percent $C_6$–$C_{10}$ aromatics.

2. The process as claimed in claim 1 in which said feed fraction comprises a light naphtha fraction having a boiling range within the range of $C_6$ to 330° F.

3. The process as claimed in claim 1 in which said feed fraction comprises a full range naphtha fraction having a boiling range within the range of $C_5$ to 420° F.

4. The process as claimed in claim 1 in which said feed fraction comprises a heavy naphtha fraction having a boiling range within the range of 330° to 500° F.

5. The process as claimed in claim 1 in which said feed fraction comprises a heavy naphtha fraction having a boiling range within the range of 330° to 412° F.

6. The process as claimed in claim 1 in which said feed is a catalytically cracked olefinic naphtha fraction.

7. The process as claimed in claim 1 in which the hydrodesulfurization catalyst comprises a Group VIII and a Group VI metal.

8. The process as claimed in claim 1 in which the first stage is carried out at a pressure of about 50 to 1500 psig, a space velocity of about 0.5 to 10 LHSV, and a hydrogen to hydrocarbon ratio of about 0 to 5000 standard cubic feet of hydrogen per barrel of feed.

9. The process as claimed in claim 8 in which the first step is carried out at a pressure of about 50 to 1500 psig, a space velocity of about 0.5 to 10 LHSV, and a hydrogen to hydrocarbon ratio of about 500 to 5000 standard cubic feet of hydrogen per barrel of feed.

10. The process as claimed in claim 1 in which the hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

11. The process as claimed in claim 10 in which the hydrodesulfurization is carried out at a temperature of about 500° to 750° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

12. A process of upgrading a sulfur-containing naphtha feed fraction boiling in the gasoline boiling range which contains mononuclear aromatics and olefins together with paraffins, which process comprises:

in a first upgrading step, converting olefins present in the feed to aromatics and aromatic side chains, cracking low octane paraffins and olefins in the feed under mild cracking conditions comprising temperature between 400° F. and 800° F. to form an intermediate product by contacting the sulfur-containing naphtha feed fraction with an intermediate pore size zeolite catalyst consisting essentially of ZSM-5 having an acid activity comprising an alpha value between 20 and 800, hydrodesulfurizing the intermediate product in the presence of a hydrodesulfurization catalyst under a combination of elevated temperature, elevated pressure and an atmosphere comprising hydrogen, to convert sulfur-containing compounds in the intermediate product to inorganic sulfur compounds and produce a desulfurized product in which the aromatic content is not more than 25 percent greater than that of the feed at a total liquid yield of at least 90 volume percent relative to the feed.

13. The process as claimed in claim 12 in which the feed fraction has an olefin content of 10 to 20 weight percent, a sulfur content from 100 to 5,000 ppmw and a nitrogen content of 5 to 250 ppmw.

14. The process as claimed in claim 12 in which the first stage upgrading is carried out at a pressure of about 300 to 1000 psig, a space velocity of about 1 to 6 LHSV, and a hydrogen to hydrocarbon ratio of about 100 to 2500 standard cubic feet of hydrogen per barrel of feed.

15. The process as claimed in claim 12 in which the hydrodesulfurization is carried out at a temperature of about 500° to 800° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

16. The process as claimed in claim 12 which is carried out in cascade mode with the entire effluent from the first reaction passed to the second reaction zone.

* * * * *